US006235220B1

(12) United States Patent
Pron et al.

(10) Patent No.: US 6,235,220 B1
(45) Date of Patent: May 22, 2001

(54) COMPOSITION FOR PRODUCING A CONDUCTIVE COMPOSITE MATERIAL CONTAINING A POLYANILINE, AND RESULTING COMPOSITE MATERIAL

(75) Inventors: Adam Pron, Grenoble; Yann-Florent Nicolau, St. Nazaire-les-Eymes; Maxime Nechtschein, St Martin d'Uriage; Françoise Genoud, Grenoble, all of (FR)

(73) Assignee: Commissariat a l'Energie Atomique (FR)

( * ) Notice: Subject to any disclaimer, the term of this patent is extended or adjusted under 35 U.S.C. 154(b) by 0 days.

(21) Appl. No.: 09/230,737

(22) PCT Filed: Jul. 28, 1997

(86) PCT No.: PCT/FR97/01408

§ 371 Date: Jan. 29, 1999

§ 102(e) Date: Jan. 29, 1999

(87) PCT Pub. No.: WO98/05040

PCT Pub. Date: Feb. 5, 1998

(30) Foreign Application Priority Data

Jan. 29, 1996 (FR) ..... 96 09521

(51) Int. Cl.[7] ..... H01B 1/00

(52) U.S. Cl. ..... 252/500; 528/422; 528/423; 528/424; 528/210; 544/157

(58) Field of Search ..... 252/500, 502, 252/511; 528/422, 423, 424

(56) References Cited

U.S. PATENT DOCUMENTS

| | | | |
|---|---|---|---|
| 5,232,631 | 8/1993 | Cao et al. | 252/500 |
| 5,320,780 | 6/1994 | Unruh | 252/500 |
| 5,436,796 | 7/1995 | Abe et al. | 361/525 |

FOREIGN PATENT DOCUMENTS

| | | | |
|---|---|---|---|
| 0294231 | 12/1988 | (EP) | H01B/1/12 |
| 0643397 | 3/1995 | (EP) | H01B/1/12 |
| 0690457 | 1/1996 | (EP) | H01B/1/12 |
| 1131288 | 5/1989 | (JP) | C09D/5/24 |
| 9528716 | 10/1995 | (WO) | H01B/1/12 |

OTHER PUBLICATIONS

F. Gubbels, Design of Electrical Composites: Key Role of the Morphology . . . 1995, 1559–1566, American Chemical Society.

Mark Knackstedt, Morphology and Marcroscopic Properties of Conducting Polymer Blends, 1996, 1369–1371, American Chemical Society.

MacDiarmid et al, Alcacer Ed., Conducting Polymers, Special Applications, Reidle, 1987 (Abstract).

"Polyaniline in the conducting state in neutral medium" Ghosh et al 1992, Synthetic Metals, 46; pp. 349–352.

*Primary Examiner*—Yogendra Gupta
*Assistant Examiner*—D G Hamlin
(74) *Attorney, Agent, or Firm*—Hayes, Soloway, Hennessey, Grossman & Hage, P.C.

(57) ABSTRACT

The invention concerns compositions for manufacturing composite materials containing a polyaniline.

These compositions are formed by a solution in a solvent such as m-cresol of the following constituents:

a) a conductive polyaniline protonated by means of a protonation agent able to promote the dissolution of the polyaniline in the solvent, for example phenylphosphonic acid, b) an insulating polymer chosen for example from amongst the cellulosic polymers and polyvinyl chlorides such as cellulose acetate, and c) an insulating plasticiser such as a mixture of dimethyl phthalate, diethyl phthalate and triphenyl phosphate.

By pouring this solution and evaporating the solvent, it is possible to obtain a flexible film of conductive composite material having good electrical and mechanical properties.

18 Claims, 1 Drawing Sheet

COMPOSITION FOR PRODUCING A CONDUCTIVE COMPOSITE MATERIAL CONTAINING A POLYANILINE, AND RESULTING COMPOSITE MATERIAL

DESCRIPTION

1. Technical Field

The object of the present invention is the manufacture of electrically conductive composite materials containing a polyaniline.

It concerns in particular the manufacture of highly transparent conductive films, having good mechanical properties, which comprise an insulating polymer host matrix in which there is distributed a conductive polyaniline conferring electrical conductivity on the whole.

Films of this type can be used in particular in electrostatic shielding or de-icing windows.

2. State of the Prior Art

In order to obtain electrical conductivity with composite materials of this type, it is necessary for the conductive polymer which constitutes the conductive phase to form a continuous lattice in the material. This can be obtained only as from a certain threshold referred to as the "percolation threshold", which can be defined as the conductive phase minimum fraction by volume which makes the material conductive on a macroscopic scale. This percolation threshold can be determined from the following formula:

$$\sigma(f)=c(f-f_c)^t$$

in which:

- $\sigma$ represents the conductivity,
- c is a constant,
- t is the critical exponent,
- f represents the fraction by volume of the conductive phase,
- $f_c$ is the fraction by volume of the conductive phase at the percolation threshold.

The publication by M. A. Knackstedt and A. P. Roberts in Macromolecules, 29, 1996, pp 1369–1371, gives explanations on the percolation threshold.

This threshold depends strongly on the morphology of the conductive phase. Thus, when the conductive phase consists of carbon black or metals, the percolation threshold is generally very high and very often greater than 0.5. However, composite materials have recently been produced whose conductive phase is formed by carbon black, which have a very much lower percolation threshold (0.4% by weight), as described by Gubbll et al in Macromolecules, 28, 1995, pp 1559–1566.

In the case of composite materials where the conductive phase consists of a conductive polymer, lower percolation thresholds can be expected using techniques of manufacturing from a solution or techniques of manufacturing by hot compression of a mixture of polymers in the solid state.

The document U.S. Pat. No. 5,232,631 describes the manufacture of composite materials from a solution of insulating polymer forming the host matrix and a conductive polyaniline in a solvent. In this case, the polyaniline is first of all caused to react with a suitable protonation agent which enables it to be made soluble in a suitable organic solvent. The solution is next used to form a film by pouring and evaporating the solvent. With these techniques very low percolation thresholds and high conductivities can be achieved.

The document EP-A-0 643 397 describes the manufacture of conductive composite materials also comprising an insulating polymer host matrix in which there is distributed a conductive polymer consisting of a polyaniline, which is obtained by hot compression moulding of a mixture of conductive polymer and the insulating polymer to which generally a plasticiser is added. As before the polyaniline can be protonated by means of an organic protonation agent and the compatibility substance can consist of an aromatic compound which, during the manufacturing of the material, dissolves the conductive polyaniline and forms a strong molecular combination therewith, and on the other hand ensures compatibility between the polyaniline and the insulating polymer.

Although the methods in solution give good results with regard to the percolation threshold, it is always of great advantage to reduce this threshold in order to obtain materials exhibiting a high electronic conductivity containing less conductive polymer (polyaniline) and having thereby better mechanical and optical properties.

This is because, in the case of conductive composite materials containing a polyaniline, the lowering of the percolation threshold is highly advantageous for the following reasons:

1) Because of the high extinction coefficients of the polyaniline for blue and red light, highly transparent green films can be obtained only provided that very low polyaniline contents are used.
2) The mechanical properties of the insulating polymer host matrix can be preserved only with a low polyaniline content in the composite material.

DISCLOSURE OF THE INVENTION

The object of the present invention is precisely compositions for the manufacture of a conductive composite material from solutions, which make it possible to obtain high conductivities with lesser quantities of conductive polymer.

According to the invention, the composition consists of a solution in a solvent of the following constituents:

a) a conductive polyaniline protonated by means of a protonation agent able to promote the dissolution of the polyaniline in the solvent,
b) an insulating polymer, and
c) a plasticiser for the insulating polymer.

In this composition, the presence of a plasticiser for the insulating polymer unexpectedly makes it possible to lower the percolation threshold of the composite material and to obtain high conductivities. Thus, in this material, the plasticiser not only gives flexibility to the insulating polymer, but in addition prevents the formation of aggregates of polyaniline by weakening the adhesion forces between the polyaniline grains. This results in a better dispersion of the polyaniline in the insulated polymer host matrix and promotes the formation of a continuous lattice of conductive polyaniline in the composite. This makes it possible, as will be seen later, to lower the percolation threshold of the composite material by a factor of 10, this being for example greater than 0.04 in the absence of a plasticiser and becoming equal to approximately 0.004 with the plasticiser.

In the composition of the invention, the insulating polymers likely to be used are polymers generally manufactured in the plasticised state such as polyvinyl chlorides and cellulosic polymers.

Advantageously, a cellulose derivative such as cellulose acetate will be used as an insulating polymer.

The plasticisers used are chosen from amongst the normal plasticisers for these types of polymer. It is possible to use in particular, alkyl and/or aryl phthalates, alkyl and/or aryl phosphates and mixtures of these compounds.

Advantageously, a mixture of dimethyl phthalate, diethyl phthalate and triphenyl phosphate is used as a plasticiser.

The conductive polyanilines used in the invention are of the emeraldine-salt form. They can be substituted or non-substituted.

It is also possible to use substituted polyanilines such as those described in the documents EP-A-0643 397 and U.S. Pat. No. 0,532,631.

In the invention, a polyaniline is used, protonated by means of a protonation agent able to promote the dissolution of the polyaniline in the solvent used. Protonation agents of this type comprise an acid function and hydrocarbon chains conferring a surfactant character on them and making them compatible with the generally used organic solvents, which thereby assists the dissolution of the polyaniline in the solvent.

By way of example of suitable protonation agents, it is possible to cite: aliphatic and/or aromatic monoesters and diesters of phosphoric acid, for example the alkyl and/or aryl esters of phosphoric acid, arylsulphonic acids and arylphosphonic acids.

In the case of esters of phosphoric acid, the aliphatic monoesters and diesters are preferred.

Preferably, the protonation agent is chosen from the group consisting of camphosulphonic acids, phenylphosphonic acid, dibutyl phosphate and dioctyl phosphate.

In the composition of the invention, the organic solvent can also be of different types but generally solvents of the phenyl type are preferred, such as cresols, in particular meta-cresol.

In the composition of the invention, the concentrations of the constituents a) protonated polyaniline, b) insulating polymer and c) plasticiser are chosen so that it is possible to obtain, by evaporation of the solvent, a composite material having a proportion by volume of polyaniline greater than the percolation threshold. Generally the ratios of the concentrations by weight of the solvent, insulated polymer and plasticiser are situated in the following ranges:

cellulose acetate/m-cresol: 5 to 12% by weight, and plasticiser/cellulose acetate: 30 to 60% by weight.

The compositions of the invention can be used for manufacturing composite materials, notably in the form of highly transparent conductive flexible films, by pouring the solution, followed by evaporation of the solvent.

Thus another object of the invention is a method of manufacturing a conductive composite material containing a polyaniline, which comprises the following steps:

1) preparing a composition consisting of a solution in a solvent of constituents a), b) and c) having the aforementioned characteristics,
2) forming the conductive composite material from the said composition by evaporation of the solvent.

Generally, the composition is prepared by mixing a first solution of the protonated polyaniline in the solvent with a second solution in the same solvent of the insulating polymer and plasticiser.

The invention also concerns an electrically conductive composite material obtained by this method, which comprises a cellulose acetate matrix in which there are distributed a protonated conductive polyaniline and a plasticiser consisting of a mixture of dimethyl phthalate, diethyl phthalate and triphenyl phosphate, the material having an electronic conductivity of $10^{-6}$ to 10 S/cm.

Advantageously, the polyaniline content of this material is 0.3% to 5% by weight.

Composition of the mixture after evaporation of the solvent:

polyaniline (calculated according to the base polyaniline) 0.3 to 5% by weight;

protonation agent 0.3 to 7% by weight;

cellulose acetate 60 to 70% by weight;

plasticiser 15 to 40%.

The polyaniline is preferably protonated by means of phenylphosphonic acid.

Other characteristics and advantages of the invention will emerge more clearly from a reading of the following examples given of course for purposes of illustration and non-limitatively, with reference to the accompanying drawings.

BRIEF DESCRIPTION OF THE DRAWINGS

FIGS. 1 to 4 correspond to the use of various protonation agents.

DETAILED DISCLOSURE OF THE EMBODIMENTS

EXAMPLE 1

Figure 1:
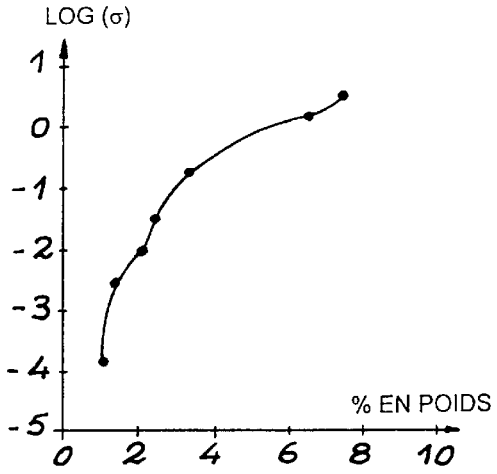
FIGS. 1 to 4 are graphs illustrating the conductivity of conductive composite materials, obtained by the method of the invention, as a function of the polyaniline content.

In this example, a composite material according to the invention is prepared, using cellulose acetate as an insulating polymer, emeraldine protonated by means of acid dioctyl phosphate as the polyaniline and a mixture of dimethyl phthalate, diethyl phthalate and triphenyl phosphate as the plasticiser.

a) Preparation of the protonated emeraldine solution Emeraldine prepared according to the method described by McDiarmid et al in L. Alcacer ed. Conducting polymers, Special Applications, Reidle, 1987, pp. 105–119. This polyaniline has the following characteristics: $M_n$=21500 and $M_w$=71000 g/mol as determined by gel permeation chromotography. The protonation of this polyaniline is effected by introducing 500 mg of polyemeraldine and 891 mg of acid diisooctyl phosphate in 100 g of m-cresol. The protonation reaction is effected for a week at room temperature whilst stirring vigorously. After one week, the soluble and insoluble fractions of protonated polyaniline are separated by centrifugation at 5000 rev/min for 15 minutes. Gravimetric analysis shows that 68% by weight of the initial emeraldine has been solubilised in the meta-cresol by protonation whilst 32% by weight remains insoluble.

b) Preparation of the solution of cellulose acetate and plasticiser in m-cresol

For a total weight of 100 g of solution, 10 g of cellulose acetate (Aldrich, molecular weight approximately 50,000 g/mol), 2.5 g of dimethyl phthalate (99% Aldrich), 2.5 g of diethyl phthalate (99% Aldrich) and 0.2 g of triphenyl phosphate (99% Aldrich) are dissolved in 84.8 g of m-cresol, at room temperature.

c) Preparation of conductive composite material

Two grams of the solution of cellulose acetate and plasticiser are mixed in m-cresol, which contains in total 304 mg of cellulose acetate and plasticiser with 1.818 g of the solution of protonated polyaniline in m-cresol (soluble polyaniline fraction separated at a), which contains 6.19 mg of emeraldine (estimated as non-protonated emeraldine).

Films are cast from this mixture by slow evaporation of the m-cresol at 50–60° C. The films have an emeraldine content of 2% by weight (estimated as non-protonated emeraldine).

The conductivity of the films thus obtained, measured by the standard technique using four spikes, is $7.10^{-2}$ S/cm.

Comparative Example 1

The same operating method is followed as in Example 1 for preparing a composite material from the same solutions, except that no plasticiser is introduced into the cellulose acetate solution.

The conductivity of the film obtained under these conditions is less than $10^{-10}$ S/cm.

This demonstrates clearly that the use of plasticiser significantly lowers the percolation threshold.

EXAMPLE 2

The same operating method as in Example 1 is followed for preparing the solution of protonated polyaniline in m-cresol and the solution of cellulose acetate and plasticiser in m-cresol, but 2 g of the solution of cellulose acetate and plasticiser containing 304 mg of cellulose acetate and plasticiser are mixed with 0.1658 g of the polyaniline solution, that is to say 2.09 mg of emeraldine (estimated in non-protonated form). The films obtained from this composition have an emeraldine content of 0.7% by weight (estimation in non-protonated form). The conductivity of the film measured as before is $3.10^{-3}$ S/cm.

Comparative Example 2

The same operating method is followed as in Example 2, except that the cellulose acetate solution does not contain a plasticiser. In this way a film is obtained having a conductivity less than $10^{-10}$ S/cm, which confirms the results obtained in Example 1 on the beneficial effect of the plasticiser.

EXAMPLE 3

In this example, the same operating method is followed as in Example 1 but, in order to prepare a film of composite material from the same solutions, but using camphosulphonic acid as a protonation agent and mixture ratios corresponding to polyaniline contents of the material ranging from 1 to 8% by weight.

FIG. 1 illustrates the results obtained, that is to say the conductivity of the composite material (log σ) according to the polyaniline content (% by weight).

EXAMPLE 4

The same operating method is followed as in Example 1, but phenylphosphonic acid is used as a protonation agent and the solutions are mixed so as to have polyaniline contents in the material of 0.5% to 1.8% by weight.

Figure 2:
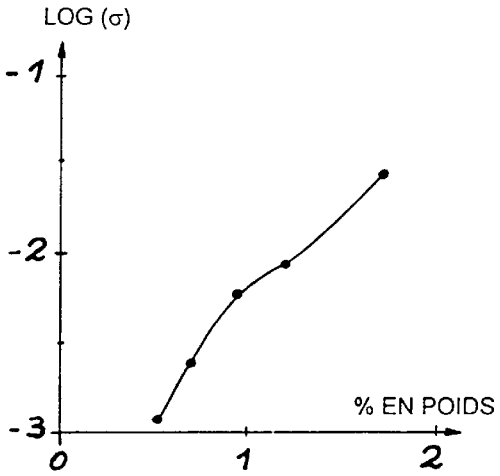

FIG. 2 depicts the conductivity of the material obtained (log σ) according to its polyaniline content (% by weight).

EXAMPLE 5

In this example, the same operating method is followed as in Example 1, but di-n-butyl phosphate is used as a protonation agent and the two solutions are mixed so as to have polyaniline content ranging from 0.5 to 11% by weight. The conductivity of the material obtained (log σ) as a function of its polyaniline content (% by weight) is given in FIG. 3.

EXAMPLE 6

The same operating method is followed as in Example 1, but using other proportions of a mixture of the two solutions in order to vary the polyaniline content of the material from 0.7 to 4% by weight.

Figure 4:
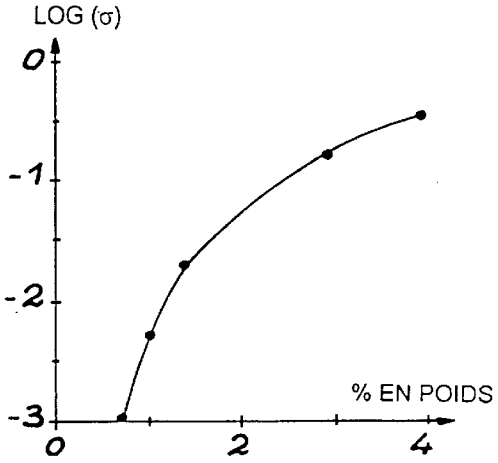

FIG. 4 illustrates the conductivity of the material (log σ) according to its polyaniline content.

The percolation thresholds calculated from the results in FIGS. 1 to 4 and of the equation:

$$\sigma(f)=c(f-f_c)^t$$

given previously are as follows:

$f_c$=0.0084 for FIG. 1 (polyaniline protonated by means of camphosulphonic acid)

Figure 3:
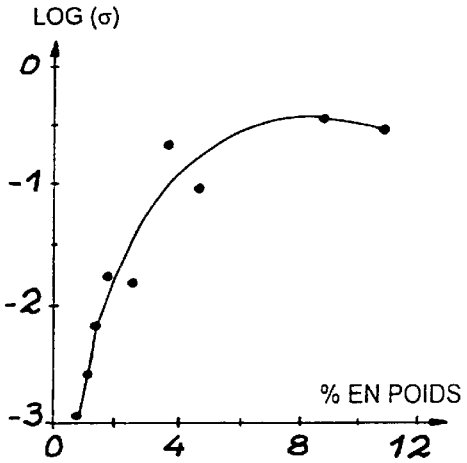

$f_c$=0.0044 for FIG. 3 (polyaniline protonated by means of di-n-butyl phosphate)

$f_c$=0.0041 for FIG. 4 (polyaniline protonated by means of diisooctyl phosphate), and $f_c$=0.0005 for FIG. 2 (polyaniline protonated by means of phenylphosphonic acid).

In the cases of composite materials produced under the same conditions as those in Examples 3 to 6, but without the addition of the plasticising mixture, the percolation thresholds are ten times greater, for example $f_c$>0.04 in this case.

In addition, microscopic observation of the materials obtained without plasticiser shows the presence of aggregates of polyaniline grains whilst such aggregates do not appear in the case of the materials prepared with the plasticising mixture.

Thus the electrical conductivity measurements and the microscopic observations confirm the role of the plasticiser in the lowering of the percolation threshold.

Another very interesting property of the films of composite material obtained in the above example is that they preserve the excellent flexibility of the plasticised cellulose acetate.

What is claimed is:

1. A composition for manufacturing a conductive composite material, characterized in that it is formed by a solution in a solvent of the following constituents:

(a) a conductive polyaniline protonated by means of a protonation agent able to promote the dissolution of the polyaniline in the solvent, (b) an insulating polymer selected from the group consisting of a cellulosic polymer and a polyvinylchloride, and (c) a plasticizer for the insulating polymer.

2. A composition according to claim 1, wherein the insulating polymer comprises cellulose acetate.

3. A composition according to claim 1, wherein the plasticizer comprises at least one compound selected from the group consisting of an alkyl and/or aryl phthalate and an alkyl and/or aryl phosphate.

4. A composition according to claim 1, wherein the plasticizer comprises a mixture of dimethyl phthalate, diethyl phthalate and triphenyl phosphate.

5. A composition according to claim 1, wherein the protonation agent is selected from the group consisting of an aliphatic and/or an aromatic monoester and a diester of phosphoric acid, an arylsulphonic acid and an arylphosphonic acid.

6. A composition according to claim 5, wherein the protonation agent is selected from a group consisting of camphosulphonic acid, phenylphosphonic acid, dibutyl phosphate and dioctyl phosphate.

7. An electrically conductive composite material comprising a matrix of cellulose acetate in which there are distributed a protonated conductive polyaniline and a plasticizer formed by a mixture of dimethyl phthalate, diethyl phthalate and triphenyl phosphate, having an electronic conductivity of $10^{-6}$ to 10 S/cm.

8. A composite material according to claim 7, wherein its polyaniline content is 0.3 to 5% by weight.

9. A composite material according to claim 7, wherein the polyaniline is protonated by means of phenylphosphonic acid.

10. A composition for manufacturing a conductive composite material, characterized in that it is formed by a solution in a solvent of the following constituents:

(a) a conductive polyaniline protonated by means of a protonation agent able to promote the dissolution of the polyaniline in the solvent, (b) an insulating polymer selected from the group consisting of a cellulosic polymer and a polyvinylchloride;

(c) a plasticizer for the insulating polymer; and (d) wherein the solvent comprises m-cresol.

11. A composition according to claim 10, wherein the ratios of the concentrations by weight of m-cresol, the insulating polymer and the plasticizer are in the following ranges:

cellulose acetate/m-cresol: 5 to 12% by weight, and plasticizer/cellulose acetate: 30 to 60% by weight.

12. A composition according to claim 10, wherein the insulating polymer comprises cellulose acetate.

13. A composition according to claim 10, wherein the plasticizer comprises at least one compound selected from the group consisting of an alkyl and/or aryl phthalate and an alkyl and/or aryl phosphate.

14. A composition according to claim 13, wherein the plasticizer comprises a mixture of dimethylphthalate and triphenyl phosphate.

15. A composition according to claim 10, wherein the protonation agent is selected from the group consisting of an aliphatic and/or aromatic monoester and a diester of phosphoric acid, an arylsulphonic acid and an arylphosphoric acid.

16. A composition according to claim 15, wherein the protonation agent is selected from a group consisting of camphosulphonic acid, phenyl phosphonic acid, dibutyl phosphate and diactyl phosphate.

17. A method of manufacturing a conductive composite material containing a polyaniline, comprising the following steps:

1) preparing a composition characterized in that it is formed by a solution in a solvent of the following constituents:

(a) a conductive polyaniline protonated by means of a protonation agent able to promote the dissolution of the polyaniline in the solvent (b) an insulating polymer selected from the group consisting of a cellulosic polymer and a polyvinylchloride, and (c) a plasticizer for the insulating polymer 2) forming the conductive composite material from the said composition by evaporation of the solvent.

18. A method according to claim 17, wherein the composition is prepared by mixing a first solution of protonated polyaniline in the solvent with a second solution in the same solvent of the insulating polymer and the plasticizer.

* * * * *